US009580852B2

(12) United States Patent
Burak et al.

(10) Patent No.: US 9,580,852 B2
(45) Date of Patent: Feb. 28, 2017

(54) PANTOGRAPH ASSEMBLY FOR MOVEABLE HEAD SEWING MACHINE

(71) Applicants: Trinity A. Burak, Meridian, ID (US); Yuri A. Itzhakov, Meridian, ID (US)

(72) Inventors: Trinity A. Burak, Meridian, ID (US); Yuri A. Itzhakov, Meridian, ID (US)

( * ) Notice: Subject to any disclaimer, the term of this patent is extended or adjusted under 35 U.S.C. 154(b) by 38 days.

(21) Appl. No.: 14/698,460

(22) Filed: Apr. 28, 2015

(65) Prior Publication Data

US 2015/0321503 A1 Nov. 12, 2015

Related U.S. Application Data

(60) Provisional application No. 61/990,877, filed on May 9, 2014.

(51) Int. Cl.

| | |
|---|---|
| ***D05C 13/00*** | (2006.01) |
| ***B43L 13/10*** | (2006.01) |
| ***B44B 3/00*** | (2006.01) |
| ***D05C 11/16*** | (2006.01) |

(52) U.S. Cl.

CPC ..... *D05C 13/00* (2013.01); *B43L 13/10* (2013.01); *B44B 3/002* (2013.01); *D05C 11/16* (2013.01)

(58) Field of Classification Search

CPC ..... D05C 13/00; B43L 13/10
USPC ..... 33/23.02
See application file for complete search history.

(56) References Cited

U.S. PATENT DOCUMENTS

| | | | | |
|---|---|---|---|---|
| 378,384 | A | 2/1888 | Pittler | |
| 420,484 | A * | 2/1890 | Whitney | B43L 13/10 33/23.05 |
| 2,672,110 | A | 3/1950 | Christopher et al. | |
| 2,618,231 | A | 11/1952 | Turner | |
| 2,624,302 | A * | 1/1953 | Meister | D05C 9/06 112/102 |
| 2,636,271 | A * | 4/1953 | Valois | B43L 13/001 33/18.3 |
| 2,806,440 | A * | 9/1957 | Schenkengel | D05C 9/06 112/103 |
| 2,823,456 | A * | 2/1958 | Valois | B43L 13/10 33/23.02 |
| 2,932,267 | A | 4/1960 | Nickerson | |
| 2,939,414 | A | 6/1960 | Slinn | |
| 2,995,098 | A | 8/1961 | Nickerson | |

(Continued)

*Primary Examiner* — Christopher Fulton
(74) *Attorney, Agent, or Firm* — Frank J. Dykas; Dykas Law Office, PLLC

(57) ABSTRACT

A pantograph assembly for a moveable head sewing machine suitable for use quilting fabric which includes a rigid extension arm having a first end and a second end and means for rigidly attaching the first end of the extension arm to a side of the head assembly of a moveable head sewing machine in a location where movement of the rigid extension arm results, either to to the left or the right in corresponding movement to the moveable head of the sewing machine, and a tracing bracket having an upper end and at least one downwardly extending lower leg configured to slide upon and over an image bearing surface medium having a design imprinted thereon to be traced, said upper bracket end rigidly attached to the second end of the extension arm, and means for indicating a point on the design to be traced, rigidly attached to rigid extension arm in close proximity to the tracing bracket.

5 Claims, 4 Drawing Sheets

(56) References Cited

U.S. PATENT DOCUMENTS

| | | | | | |
|---|---|---|---|---|---|
| 3,451,366 | A * | 6/1969 | Beck | D05B 21/00 | 112/102 |
| 4,175,329 | A | 11/1979 | Schimmel et al. | | |
| 4,419,945 | A * | 12/1983 | Nishina | D05B 3/243 | 112/102.5 |
| 4,953,485 | A | 9/1990 | Brower et al. | | |
| 5,003,895 | A | 4/1991 | Talanker | | |
| 5,165,175 | A * | 11/1992 | Anderson | B23Q 35/20 | 33/23.05 |
| 5,228,401 | A | 7/1993 | Moore, III | | |
| 6,374,760 | B1 | 4/2002 | Moore, III | | |
| 6,860,211 | B2 * | 3/2005 | Valeriote | D05B 11/00 | 112/117 |
| 7,984,681 | B1 * | 7/2011 | Oxley | D05B 11/005 | 112/153 |
| 9,010,259 | B2 * | 4/2015 | Schwarzberger | D05B 11/00 | 112/117 |
| 9,267,222 | B2 * | 2/2016 | Schnaufer | D05B 19/12 | |
| 2009/0272304 | A1 | 11/2009 | Watts | | |
| 2016/0115631 | A1 * | 4/2016 | Elliott | D05C 9/06 | 112/475.19 |

* cited by examiner

PANTOGRAPH ASSEMBLY FOR MOVEABLE HEAD SEWING MACHINE

PRIORITY/CROSS-REFERENCE TO RELATED APPLICATIONS

This application claims the benefit of U.S. Provisional Application No. 61/990,877, filed May 9, 2014 the disclosure of which is incorporated by reference.

TECHNICAL FIELD

The presently disclosed technology relates to a pantograph system for use with a moveable head sewing machine of the type used to embroider quilts.

BACKGROUND

The vast majority of sewing machines sold for residential use and indeed, for commercial use are of the fixed head and needle plate type. This is the traditional design and it is intended that the fabric work piece be moved by one means or another underneath the fixed head as opposed to moving the head relative to a fixed fabric work piece. In a typical sewing machine the needle head is aligned with the needle plate fixed to the base plate. The upper needle head is positioned at the distal end of an upper arm, which is interconnected to the lower arm which holds the base plate. This is often called the "throat" of the sewing machine and it is fixed in length; the longer the arms, the longer the throat of the sewing machine. A bobbin is located beneath the needle plate for the second portion of the thread to be fed through and there are usually a pair of feed dogs which are used to advance the fabric to be sewn underneath the needle. This conventional design is eminently practical and useful for the fabrication of items: clothing, as the fixed head and base plate assemblies are relatively small so that they can be inserted into a sleeve for a garment for example.

These fixed sewing machines can also be used to fabricate patch work quilts as they work well stitching in a straight line to sew together to pieces of quilt material. However, they do not work well when attempting to create a decorative quilt that has quilting stitching sewn in a decorative pattern, for example: displaying decorative outlines of horses running or rearing up on their hind legs.

A pantograph is generally defined as an instrument for copying and drawing a design on a different scale by a system of hinged or jointed rods. They have been known and used since the early 1600s. Generally there is one arm of the pantograph containing the small pointer while the other holds a drawing implement and by moving the pointer over a diagram, a copy of the diagram can be drawn on another piece of paper. By changing the positions in the arms in the linkage between the pointer and the drawing arm, the scale image produced can be changed from a direct 1:1 scale to a larger or smaller duplicate image. However, it is not a requirement that the pantograph be capable of adjusting the scale of the drawn image. In the sewing and quilting industry the term pantograph is commonly used simply replicating a design on a one to one scale.

These two technologies have been combined, for at least the past one hundred years to create an ability to replicate an embroidery design on a piece of fabric using a fixed head sewing machine. To achieve this goal, the drawing arm of the pantogram is not affixed to a right drawing instrument but rather is affixed to the fabric hoops in which the fabric work piece is secured. The fabric hoops move the work piece underneath the needle arm in direct relation to the movement of the pointer on the drawing and the pantogram arm is moved about by the operator. However, this only works for relatively small work pieces and is not readily adaptable for use with quilts which may be quite large, for example: ten feet long and six feet wide, and especially in cases where the embroidered design is to cover a major portion of the quilt with a decorative stitching of the desired design.

It is also possible to fix the quilt work piece to a fabric frame and stretch it underneath the fixed head work piece as long as the frame is connected to a movable carriage which moves in both the x and y direction, and may be computer-controlled. There are many prior art designs for quilting machines that incorporate this design. However, such a machine would require a lot of floor space and is not suitable for use in a residential home environment.

As a result, movable head sewing machines have been developed where the basic design can be described as having a stationary fabric frame, which is sometimes as long as fourteen feet from one end to the other, a sewing machine carriage which carries a fixed head and arm sewing machine that is movable in both the x and y direction, and typically employs handles, either at the rear or the front of the moveable head to control movement. It may also controlled by use of foot pedals to move the head relative to the stationary work piece which is stretched on the stationary frame. This design minimizes the floor space requirements for the machine, and quilting enthusiasts use these machines to create decorative quilts that are often times ten or twelve feet in length from one end to the other and several feet wide.

What is needed is some mechanism by which the moving head can be controlled with something like a pantograph so that a design can be traced from an image-bearing surface, such as a photograph, painting, or a line drawing, or even another embroidered product and the moving sewing machine head can be used to replicate whatever image is being replicated on the quilting fabric which is held in fixed relationship to the pantograph device.

SUMMARY OF THE DISCLOSURE

The purpose of this Summary is to enable the public, and especially the scientists, engineers, and practitioners in the art who are not familiar with patent or legal terms or phraseology, to determine quickly from a cursory inspection, the nature and essence of the technical disclosure of the application. This Summary is neither intended to define the inventive concept(s) of the application, which is measured by the claims, nor is it intended to be limiting as to the scope of the inventive concept(s) in any way.

The pantograph assembly is formed from an extended ridged arm having a clamping mechanism at one end and an A-frame bracket having a pair of horizontal slide surfaces and handles at the other end. The clamping mechanism is used to attach the pantograph assembly to the body of the moveable sewing head in a position where the pantograph assembly extends to one side or the other of the moveable sewing head.

The design or image to be reproduced by the pantograph assembly is positioned underneath the bracket, and a battery powered laser light rod is activated to illuminate a precise point on the design or image as a starting point for replicating the design or image. While the bracket described in the preferred embodiment has an A-frame shape, there are many alternative designs that will work equally well, such as a rectangular shaped bracket, or a single vertical post extending down from the rigid arm. The same can be said of the use of a laser light rod marker. A stylus or even a pen or pencil will also serve the function of tracing the image.

The bracket assembly is comprised of plate and bolts. In one of the preferred embodiments one of the bolts extends through corresponding elongated slots and the rigid arm and the plate so as to provide a means of adapting the pantograph assembly to a variety of different movable head sewing machine designs by various manufacturers. The bracket assembly and the rigid arm are positioned for attachment to a portion of the lower arm moveable sewing machine head toward the rear of the throat in a position wherein the bottom slide pads on the bottom of the bracket lightly slide and glide over the image to be replicated with the pointer or laser light rod. The slide pads have a smooth underside finish so as to smoothly glide over the design or image in the event the bracket rests upon the image to be duplicated as the operator. The sewing head moves with the pantograph assembly and the design can be replicated on the quilting material on the scale of 1:1.

The pantograph is adapted to be attached to the lower arm and extend out to the side of the sewing head of the movable head sewing machine and the pantograph bracket is sized to glide in the same or parallel plane as the fixed work piece underneath the sewing head. The image or design to be replicated rests upon a table like surface adjacent to, and slightly behind the work piece to be stitched. This is done for a number of reasons.

If the stationary fabric work piece fastened to a frame that is positioned at standard table height, then the operator of the pantograph can literally remain seated in a chair at the work table next to the movable head sewing machine with both the fabric work piece and the image or design to be replicated with the pantograph and trace out the decorative design from the image bearing surface onto the work piece quickly and accurately with smooth motions resulting from smooth or steady flow of movement over the image to be duplicated because the operator can see both the image and the fabric work piece at the same time. This is a significant advantage to elderly or physically impaired sewing machine operators as it eliminates the need to stand behind the moveable sewing machine head, and have to bend or lean over or around the moveable head to see the design as it is being stitched under the head.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE PREFERRED EMBODIMENTS

Figure 1:
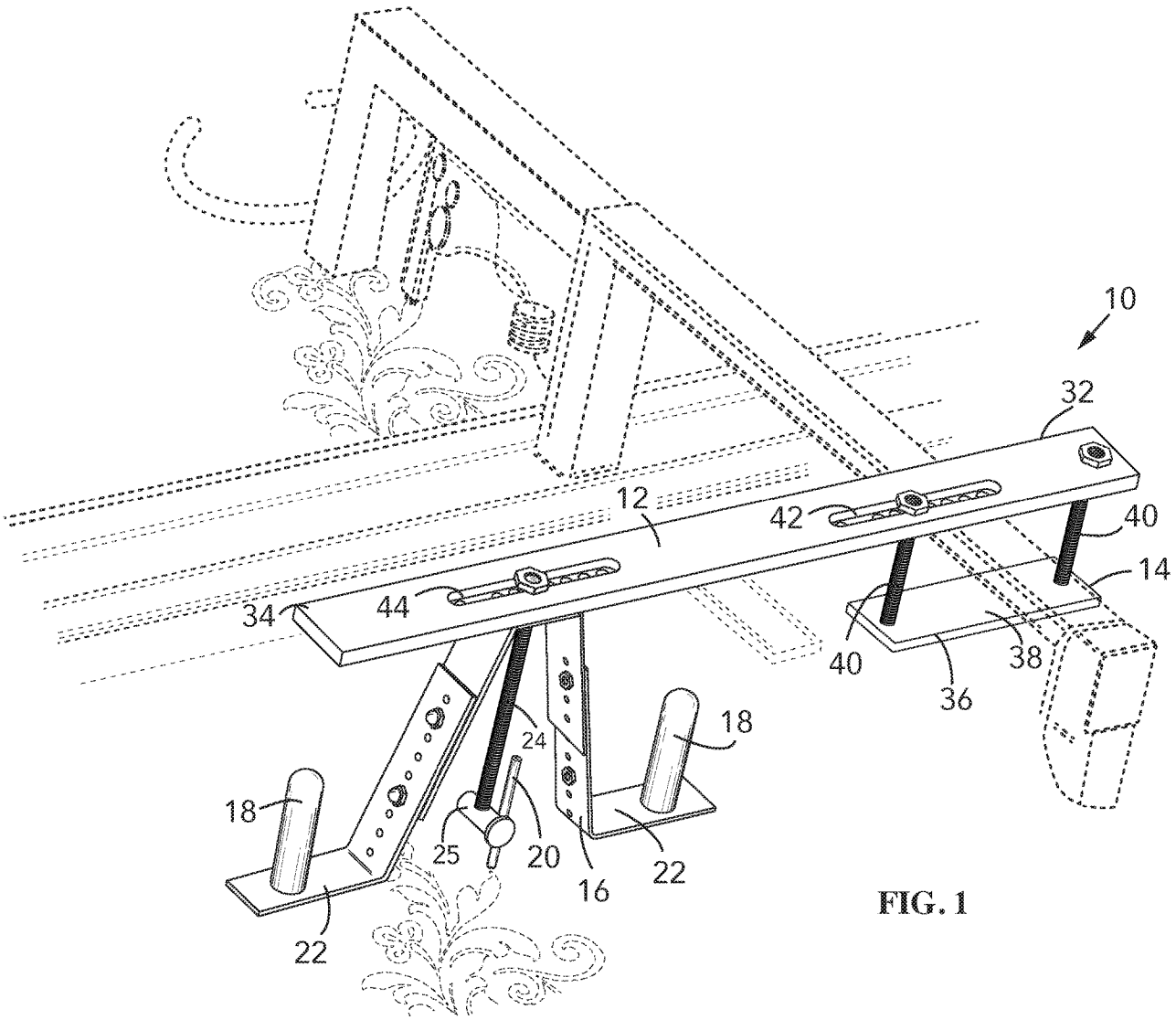
FIG. 1 is perspective representational view of the pantograph assembly.
Figure 2:
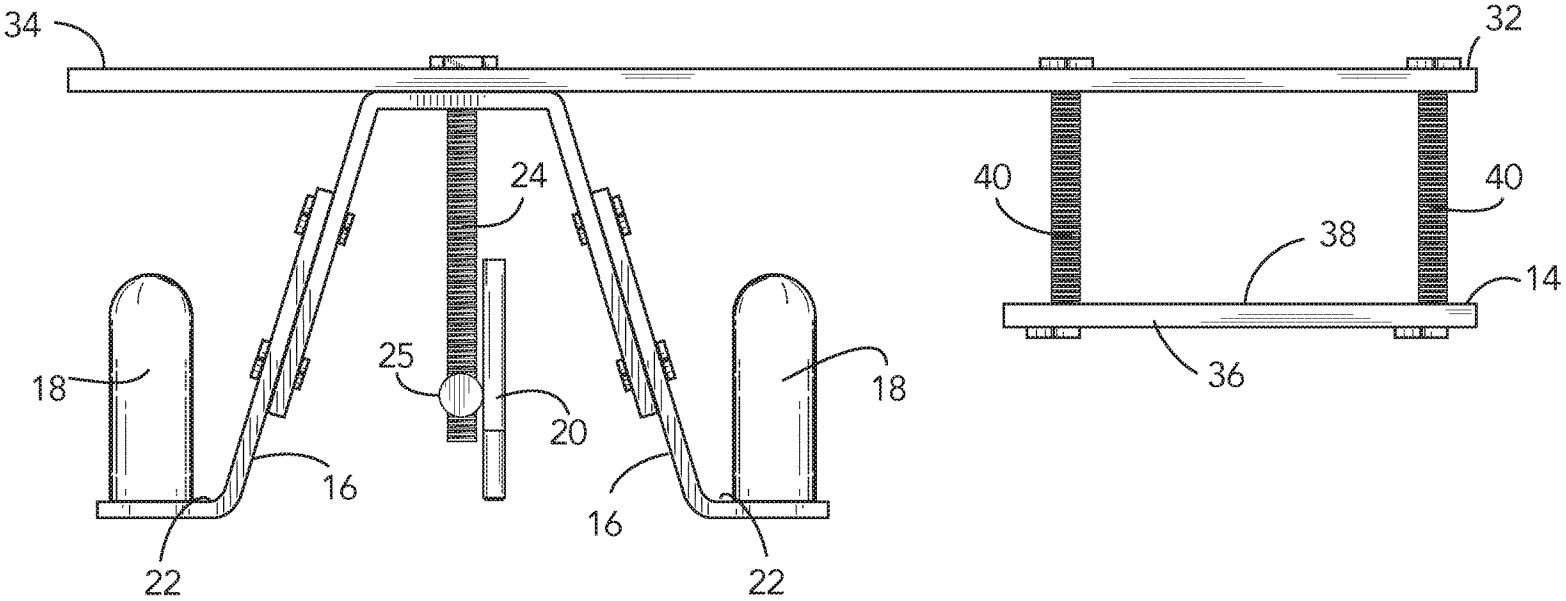
FIG. 2 is a front plan view of the pantograph assembly.
Figure 4:
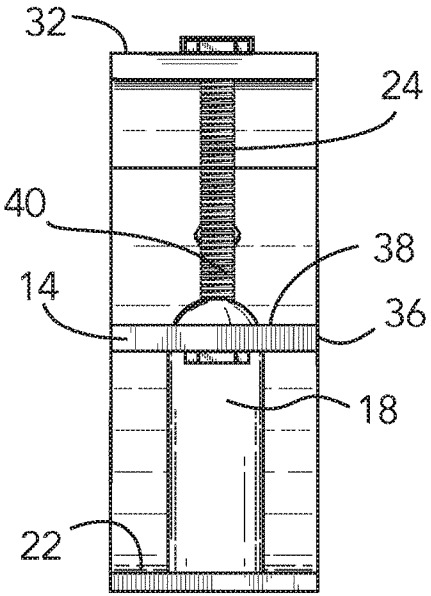
FIG. 4 is a second end view of the pantograph assembly showing the clamping mechanism.
Figure 3:
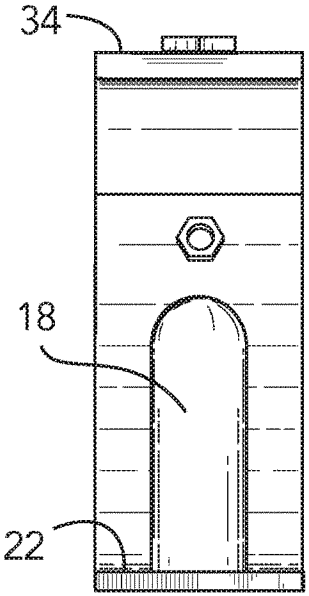
FIG. 3 is a first end view of the pantograph assembly showing the handle end.
Figure 5:
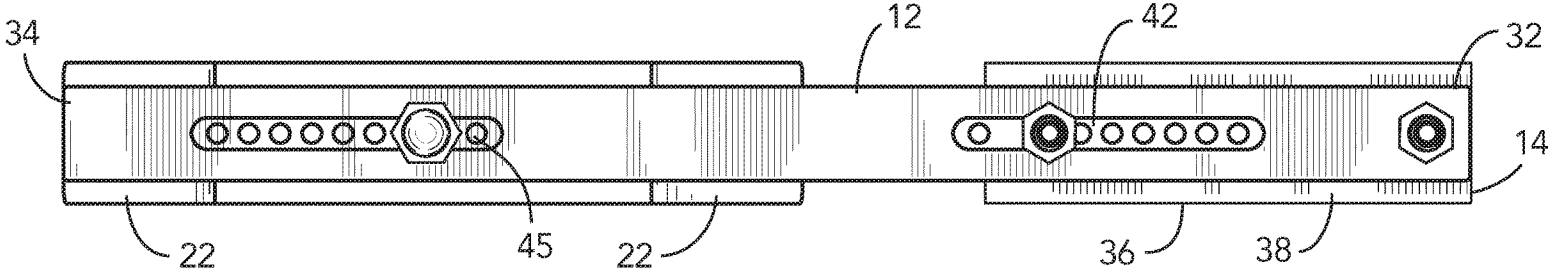
FIG. 5 is a top plan view of the pantograph assembly.
Figure 6:
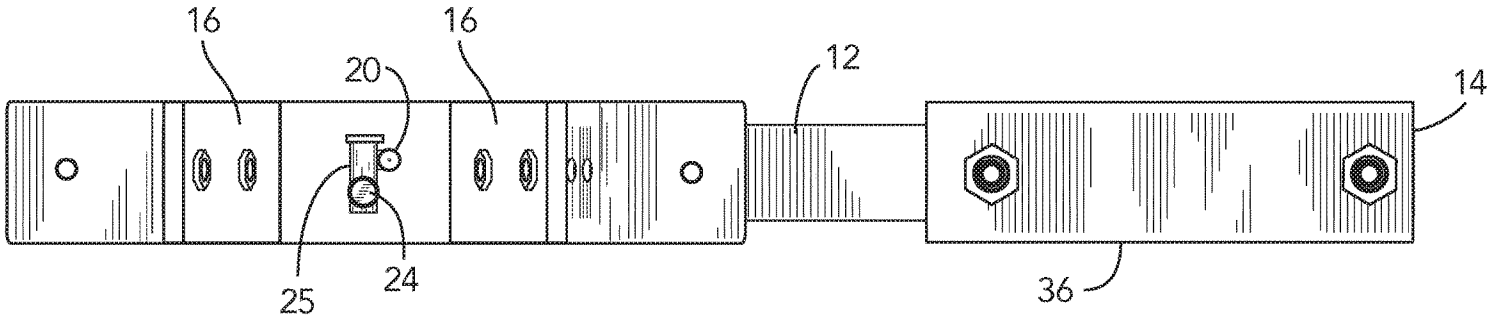
FIG. 6 is a bottom plan view of the pantograph assembly.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

First referring to FIGS. 1 through 6 there is shown to advantage our new design for a pantograph for use with a movable head sewing machine. The pantograph assembly 10 is formed of extended ridged arm 12, a clamping mechanism 14, an adjustable A-frame bracket 16 having a pair of horizontal slide surfaces 22, and handles 18.

The design or image to be reproduced by the pantograph 10 is positioned underneath the bracket, and laser light rod 20, which may be battery powered, is activated to illuminate a precise point on the design or image as a starting point for replicating the design or image. While adjustable bracket 16, in the preferred embodiment has an A-frame shape, there are many alternative designs, not shown, that will work equally well, as a rectangular shaped bracket, or a single vertical post extending down from rigid arm 12. The same can be said of the preferred laser light rod marker 20. A stylus or even a pen or pencil will also serve the function of tracing the image. In the preferred embodiment, laser light rod 20, or a stylus if one is in use, is height adjustable and held in place by bracket 26 which is attached to adjustment bolt 24.

The first end 32 of ridged arm 12 is adapted for use with a bracket assembly 36 comprised of plate 38 and bolts 40. In the preferred embodiment one of the bolts extends through an elongated slot 42 so as to provide a means of adapting the pantograph assembly 10 to a variety of different movable head sewing machine designs by various manufacturers. The slots are provided in the general vicinity of the second end 34 of ridged arm 12 as a means of adapting or adjusting the location of a frame bracket 16 in or out along ridged arm 12 depending upon the location of the design relative to the work piece. As shown in FIG. 1,the pantograph assembly 10 is attached to the lower rear arm of the throat of the moveable head sewing machine assembly. This positions the laser light pointer 20 to the side and slightly to the rear of the sewing machine frame assembly where there is typically found a flat table like surface which can be used to support the design or image to be replicated. It doesn't matter if the pads 22 rest atop or above the design or image to be replicated, as rigid bar 12 is strong enough to support the weight of the users hands when gripping and moving the handles 18.

Slide pads 22 are intended to have a smooth underside finish so as to smoothly glide over, or upon the design shown in FIG. 1 as 44 to be duplicated as the operator who, with both hands on handles 18, deftly moves the pantograph to trace the outline of the design to be replicated. The sewing head moves with it and the design can be replicated on the quilting material on the scale of 1:1.

In the preferred embodiment, the pantograph is adapted to be attached to the rear portion of the lower arm of sewing head of the movable head sewing machine and the pantograph bracket 16 is sized to glide in the same or parallel plane as the fixed work piece underneath the sewing head over or upon an image which rests upon a flat surface adjacent to the work piece to be stitched which serves as a table for holding the design or image to be replicated. This is done for a number of reasons.

If the stationary fabric work piece fastened to a frame that is positioned at standard table height, then the operator of the pantograph can literally sit down in a chair behind the work table next to the movable head sewing machine with both the fabric work piece and the image or design to be replicated with the pantograph and trace out the decorative design from the image bearing surface onto the work piece quickly and accurately with smooth motions resulting from smooth or steady flow of movement over the image to be duplicated because the operator can see both the image and the fabric work piece at the same time. This is a significant advantage to elderly or physically impaired sewing machine operators as it eliminates the need to stand behind the moveable sewing machine head to use the standard handles that are normally used to move the sewing head, or to have to bend or lean over or around the moveable head to see the design as it is being stitched under the head.

While it is obviously feasible, from a design standpoint, to design a latching system to extend rigid arm 12 to the front or the rear, it is not the preferred embodiment. If the pantograph extends to the rear of the moveable sewing head, instead of to the side, it effectively doubles the floor space required to the proper operation of the machine and greatly restricts the operator ability to monitor both the position of the pointer and fabric work piece at the same time. If the pantograph extends to the of the moveable sewing head, again the required floor space effectively doubles, and while visibility of the fabric work piece is not impaired as much, it precludes access to the moveable head, and bobbin from the front.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

We claim:

1. A pantograph assembly for a moveable head sewing machine suitable for use quilting fabric which comprises:

a rigid extension arm having a first end and a second end;

means for rigidly attaching the first end of the extension arm to a side of the head assembly of a moveable head sewing machine in a location where movement of the rigid extension arm results in corresponding movement of the moveable head of the sewing machine;

a tracing bracket having an upper end and at least one downwardly extending lower leg configured to slide upon and over an image bearing surface medium having a design imprinted thereon to be traced, said upper bracket end rigidly attached to the second end of the extension arm; and means for indicating a point on the design to be traced, rigidly attached to rigid extension arm in close proximity to the tracing bracket.

2. The pantograph assembly of claim 1 wherein the tracing bracket further comprises at least two downwardly extending lower legs configured to slide above the image bearing surface medium.

3. The pantograph assembly of claim 2 wherein the means for indicating a point on the design to be traced is configured to indicate a point on the design to be traced between the two downwardly extending legs.

4. The pantograph assembly of claim 1 wherein the means for indicating a point on the design to be traced is a laser light rod for illuminating a point on the design to be traced.

5. The pantograph assembly of claim 1 wherein the means for indicating a point on the design to be traced is a stylus.

* * * * *